US005512319A

United States Patent [19]

Cook et al.

[11] Patent Number: 5,512,319

[45] Date of Patent: Apr. 30, 1996

[54] POLYURETHANE FOAM COMPOSITE

[75] Inventors: John H. Cook, Plymouth; Egils Grinbergs, Farmington Hills, both of Mich.

[73] Assignee: BASF Corporation, Mt. Olive, N.J.

[21] Appl. No.: 294,211

[22] Filed: Aug. 22, 1994

[51] Int. Cl.[6] ..... B05D 3/10; B05D 5/00; B29D 9/00

[52] U.S. Cl. ..... 427/244; 427/322; 427/373; 427/387; 264/45.6

[58] Field of Search ..... 427/373, 387, 427/244, 412, 412.4, 322, 301; 264/46.4, 45.6

[56] References Cited

U.S. PATENT DOCUMENTS

| | | | |
|---|---|---|---|
| 2,834,748 | 5/1958 | Bailey et al. . | |
| 3,219,502 | 11/1965 | Willy . | |
| 3,562,786 | 2/1971 | Bailey et al. . | |
| 3,741,917 | 6/1973 | Morehouse . | |
| 3,871,909 | 3/1975 | Aldrich | 427/322 |
| 4,022,941 | 5/1977 | Prokai et al. | 427/407.1 |
| 4,044,178 | 8/1977 | Abel et al. | 427/389.9 |
| 4,147,847 | 4/1979 | Schweiger | 521/112 |
| 4,207,071 | 6/1980 | Lipowitz et al. | 427/387 |
| 4,218,498 | 8/1980 | Cohen | 427/336 |
| 4,353,955 | 10/1982 | Cook | 427/299 |
| 4,490,416 | 12/1984 | Westall et al. | 427/387 |
| 4,596,725 | 6/1986 | Kluth et al. | 427/393.6 |
| 5,124,368 | 6/1992 | Gill et al. | 264/46.4 |
| 5,389,318 | 2/1995 | Thary | 264/46.4 |
| 5,432,206 | 7/1995 | Stanga et al. | 521/110 |
| 5,458,905 | 10/1995 | Heagle | 427/244 |
| 5,472,987 | 12/1995 | Reedy et al. | 521/106 |

*Primary Examiner*—Diana Dudash
*Attorney, Agent, or Firm*—Dennis V. Carmen

[57] ABSTRACT

The present invention is directed to a method of applying a polyurethane foam to a fabric and the product produced thereof. This method involves (a) coating the fabric with a silicone surfactant dissolved in water, and (b) expanding the polyurethane foaming mixture in contact with the coated portion of the fabric.

21 Claims, No Drawings

POLYURETHANE FOAM COMPOSITE

FIELD OF THE INVENTION

The present invention relates to a method of applying polyurethane foam to fabric in which a polyurethane foaming mixture is expanded against the fabric for the purposes of adhering the foam to the fabric and to the produce produced thereby.

DESCRIPTION OF THE PRIOR ART

Polyurethane foams are foamed by reacting a polyisocyanate with a polyol which may be a polyether containing hydroxyl groups or a polyester containing hydroxyl groups in the presence of a blowing agent, a catalyst, and a surfactant. The blowing agent may be $CO_2$ generated by a water/isocyanate reaction. Other blowing agents include methylene chloride, hydrofluorochlorocarbons, partially or fully fluorinated hydrocarbons, or volatile hydrocarbons, whereby heat generated when the polyisocyanate reacts with the polyol evaporates the blowing agent so it passes through the liquid mixture forming bubbles therein.

It is well known to those skilled in the art to apply such foams to fabrics by expanding a polyurethane foaming mixture against the fabric for the purpose of adhering the foam to a fabric.

The usefulness of fabrics in related articles having a foam sheet applied to one face thereof is well recognized. Of these composite foam fabric products, the most in demand are those in which a polyurethane foam is used. Heretofore, the most common method of applying foam to fabrics was first to foam a thin sheet of foam and then apply the foam to the fabric by the use of an adhesive to form a foam-fabric laminate. The use of adhesives has proven objectionable where the desired result is to form a composite foam-fabric product, such as a foam-fabric cloth, which must possess permeability to air so that it can be said to breathe. Further, the adhesive in the resultant product tends to render the product less resilient, less flexible, more dense and less absorbent than ordinary homogenous foam; and the foam-fabric cloth itself loses its drape.

In an effort to eliminate the adhesive from the composite, one method proposed was to spread a liquid chemical foaming mixture with the fabric and then allow the mixture to expand. When pouring many flexible foam systems against a fabric, there is a tendency for the liquid mixture to be absorbed into the fabric as the bubbles are being formed. This causes the cells at the fabric-foam surface to collapse and coalesce into large cells and voids.

Accordingly, it is one of the purposes of the instant invention to provide an improved method of applying polyurethane foam to fabric whereby an improved composite product is produced.

It is also an object of the invention to provide an improved method of applying a polyurethane foam to a fabric to reduce void formation and a delamination at the foam/fabric interface, while providing a fine cell structure to improve the soft feel of the foam. It is a further object of the invention to ensure that in practicing such method, environmentally friendly ingredients are employed in any coatings or sprays used to make the final composite in order to reduce or eliminate volatile emissions while maintaining the excellent fine cell structure, adhesion, and soft feel at the foam/fabric interface of the foam composite.

The Kollmeier et al (U.S. Pat. No. 4,139,503), Morehouse (U.S. Pat. No. 3,669,913), Watkinson (U.S. Pat. No. 3,920,587), Windermuth et al (U.S. Pat. No. 4,163,830), Gmitter et al (U.S. Pat. No. 3,050,477), Schweiger (U.S. Pat. No. 4,147,847), Moeller (U.S. Pat. No. 4,081,410), and Prokai et al (U.S. 4,022,941) references all disclose the incorporation of silicone surfactants in a polyurethane foaming mixture. While this helps to prevent the problem of void and large cell formation described above, it has the drawback of creating a very closed-cell foam which shrinks even when crushed.

The Willy patent (U.S. Pat. No. 3,219,502) discloses a method of applying a polyurethane foam to a fabric wherein the fabric is previously treated with a liquid prior to applying the foam. Generally, an aqueous liquid is applied, preferably tap water, prior to expansion of the foaming mixture on the fabric.

The Parsson patent (U.S. Pat. No. 4,092,387) discloses a method for producing articles of cellular plastic material provided with a surface covering of thermoplastic material or textile where the side of the covering facing the cellular plastic material is treated with a chemical substance. The cellular plastic material is then said to be able to expand freely in a mold and to bond to the covering without forming a deformed cellular structure in the boundary layer of the cellular plastic material adjacent to the covering. There is no disclosure in this patent of the use of a silicone surfactant.

We have previously discovered and disclosed in U.S. Pat. No. 4,353,955 that a silicone surfactant may be applied to a fabric after which a foaming mixture is expanded on the coated fabric. In this process, however, the silicone surfactant was dissolved in methylene chloride, a substance which not only is classified as a volatile organic compound (VOC); but it is also a class I substance banned under the Montreal Protocol due to its high ozone depletion potential.

SUMMARY OF THE INVENTION

The present invention is directed to a foam composite material comprising (a) a layer of fabric, (b) a silicone surfactant coating which was dissolved in water on said fabric, and (c) a layer of polyurethane foam affixed to said coated portion of said fabric. These products are prepared by the method of coating a portion of fabric with a silicone surfactant dissolved in water and expanding a polyurethane foaming mixture in contact with the coated portion of the fabric.

DETAILED DESCRIPTION OF THE INVENTION

As used herein, the expression "fabric" includes a film or foil or thin layer of a textile fabric such as a nylon, or a plastic material such as a vinyl or polyurethane material with a textile fabric attached to one side thereof or reinforced plastic which is reinforced with a textile fabric.

The silicone surfactant coating is preferably applied to the fabric in an amount of about 0.01 to 2.0 grams per square foot.

Any silicone surfactant employed in the manufacture of polyurethane foams may be employed for this purpose so long as the silicone surfactant forms a clear solution, with or without additives, which does not phase separate from water for at least one hour at 25° C. Other additives may be used in the aqueous coating such as mono-alcohols or glycols which may aid in the solvation of the surfactant in water. However, it is preferred that the surfactant is soluble in water and forms a solution therein, without the aid of other solvating agents. At least 50 weight percent, more preferably 90 weight percent, most preferably 100 weight percent, of the solvent in the coating, based on the weight of the solvents, is water.

The preferred silicone surfactants are polysiloxane-oxyalkylene copolymers. An example of high molecular weight polymers of this type (hereinafter called siloxaneoxyalkylene copolymer A) is a hydrolyzable siloxane-oxyalkylene copolymer (hereinafter called siloxane-oxyalkylene copolymer A-1) expressed by the general formula (I):

$$(R^1)(SiO_3)_x(R_2SiO)_y[(CnH_{2n}O)_zR'']_a[R''']_{3x-a}$$

wherein x is an integer of at least 1 and stands for the number of trifunctional silicon atoms; y is an integer of at least 3 and stands for the number of difunctional siloxane units; z is an integer of at least 5 and stands for the length of a polyoxyalkylene chain; a is an integer and stands for the number of polyoxyalkylene units; n is an integer of 2 to 4 and stands for the number of carbon atoms in an oxyalkylene group; R is a monovalent hydrocarbon group, e.g., alkyl or aralkyl; R' is an x-valent hydrocarbon group, e.g., when x is 1, a monovalent hydrocarbon group such as alkyl, when x is 2, a divalent hydrocarbon groups such as alkylene, when x is 3, a trivalent hydrocarbon group and when x is 4, a tetravalent hydrocarbon group; R" is a monovalent hydrocarbon group, e.g., alkyl or aralkyl, forming a monoether group at the end of an alkylene chain; and R''' is an alkyl group or trihydrocarbylsilyl group at an end of a siloxane group, characterized by containing 10 to 80 percent by weight polysiloxane units and 90 to 20 percent by weight of polyoxyalkylene units, having polysiloxane chains and polyoxyalkylene chains bonded with a C—O—Si bond and having a molecular weight of 1,000 to 16,000.

Alternatively, as siloxane-oxyalkylene copolymer A in the present invention can also be used a non-hydrolyzable siloxane-oxyalkylene copolymer (hereinafter called siloxaneoxyalkylene copolymer A-II) expressed by the general formula (II):

$$R_3SiO(R_2SiO)_3[R'''O(CnH_{2n}O)_{22}CnH_{2n}SiRO]_wSiR_3$$

wherein w is an integer of at least 1 and y, z, n, R, and R''' are the same as defined in the above formula (I), characterized by containing 5 to 95 percent by weight, preferably 5 to 50 percent by weight of polysiloxane units and 95 to 5 percent by weight, preferably 95 to 50 percent by weight of polyoxyalkylene units, having a polysiloxane chain and a polyoxyalkylene chain bonded with a C—Si bond (instead of a C—O—Si bond) and having a molecular weight of 1,000 to 16,000.

As an example of a low molecular weight siloxane-oxyalkylene copolymer (hereinafter called siloxane-oxyalkylene copolymer B) there can be mentioned a hydrolyzable siloxaneoxyalkylene copolymer (hereinafter called siloxane-oxyalkylene copolymer B-I) expressed by the general formula (III):

$$(R')(SiO_3)_x(R_2SiO)_y[(CnH_{2n}O)_zR'']_a[R''']_{3x-a}$$

where x is an integer of at least 1 and stands for the number of trifunctional silicon atoms; y is an integer of at least 3 and stands for the number of difunctional siloxane units; z is an integer of 0 or 1 to 4 and stands for the length of a polyoxyalkylene chain; a is an integer and stands for the number of polyoxyalkylene units; n is an integer of 2 to 4 and stands for the number of carbon atoms in an oxyalkylene group; R is a monovalent hydrocarbon group such as alkyl, aryl or aralkyl; R' is an x-valent hydrocarbon group, e.g., when x is 1, a monovalent hydrocarbon group such as alkyl and when x is 2, a divalent hydrocarbon group such as alkylene; R" is a monovalent hydrocarbon group such as alkyl, aryl or aralkyl and forms a monoether group at the end of a polyoxyalkylene chain; and R''' is an alkyl group or trihydrocarbylsilyl group at an end of a siloxane group, characterized by containing more than 80 percent by weight of polysiloxane units and less than 20 percent by weight of polyoxyalkylene units, having a polysiloxane chain and a polyoxyalkylene chain bonded with a C—O—Si bond and having a molecular weight of 500 to 10,000.

Alternatively, as siloxane-oxyalkylene copolymer B in the present invention can also be used a non-hydrolyzable siloxane-oxyalkylene copolymer (hereinafter called siloxane-oxyalkylene copolymer B-II) expressed by the general formula (IV):

$$R_3SiO(R_2SiO)_y[R'''O(CnH_{2n}O)_zCnH_{2n}SiRO]_wSiR_3$$

where w is an integer of at least 1, 6, z, n, R and R''' are the same as defined in the above formula (III), characterized by containing more than 95 percent by weight of polysiloxane units and less than 5 percent by weight of polyoxyalkylene units, having a polysiloxane chain and a polyoxyalkylene chain bonded with a C—Si bond (instead of a C—O—Si bond) and having a molecular weight of 500 to 10,000. The above polysiloxane-polyoxyalkylene copolymers are described in U.S. Pat. No. 4,119,582.

The siloxane-oxyalkylene copolymer may be prepared by reacting a monoalkylene ether, preferably the allyl ether, of the desired polyoxyalkylene glycol with a siloxane containing SiH group.

The reaction is carried out by heating a mixture of the two reactants in the presence of a platinum catalyst such as chloroplatinic acid dissolved in a small amount of isopropyl alcohol, at temperatures from 100° to 200° C.

The siloxanes can be of four formulae:

$R_aSi[(OSiMe_2)_n(OSiMeH)_dOSiMe_2H]_{4-a}$ $HMe_2Si(OSiMe_2)_n(OSiMeH)_bOSiMe_2H$ $Me_3Si(OSiMe_2)_n(OSiMeH)_cOSiMe_3$ and $R_aSi[(OSiMe_2)_n(OSiMeH)_cOSiMe_3]_{4-a}$ wherein R is a hydrocarbon radical free of aliphatic unsaturation and contains from 1 to 10 carbon atoms. Me is a methyl radical; a has an average value from 0–1; n has an average value from 6–240; d has an average value from 0–30; b has an average value from 1–30; and c has an average value from 3–30 to the extent that the ratio of total $Me_2SiO$ units to total $$-\underset{\underset{G}{|}}{Si}-O$$

units is within the range of 3.5:1 to 15:1, wherein G is a radical of the structure $—D(OR'')_{mA}$ wherein D is an alkylene radical containing from 1 to 30 carbons atoms.

A is a radical selected from the group consisting of the —OR', —OOCR' and —OCOR' radicals wherein R' is a radical free of aliphatic unsaturation selected from the group consisting of hydrocarbon and radicals, the A radical containing a total of less than 11 atoms. R" is composed of ethylene radicals and radicals selected from the group consisting of propylene and butylene radicals, the amount of ethylene radicals relative to the other alkylene radicals being such that the ratio of carbon atoms to oxygen atoms in the total OR" block ranges from 2.3:1 to 2.8:1, and m has an average value from 25 to 100.

Any of the siloxanes 1–4 or mixtures of siloxanes 1–4 can be utilized which give rise to a copolymer when reacted with an unsaturated glycol, in which the ratio of total Me2SiO units to total

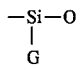

units are derived from the corresponding SiH units so that the same ratio of $Me_2SiO$ units to SiH units prevails as for the $Me_2SiO$ units to

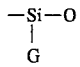

units.

The above siloxanes are prepared by cohydrolyzing the appropriate siloxanes as for instance in (1) above, a mixture of silanes such as $R_aSiX_{4-a}$ with dimethyldichlorosilane, methyldichlorosilane, and dimethylmonochlorosilane, and thereafter equilibrating the cohydrolyzate with an acid catalyst such as $H_2SO_4$. Number (2) is prepared by cohydrolyzing the silanes in portion of n moles of dimethyldichlorosilane, two moles of dimethylmonochlorosilane, and b moles of methyldichlorosilane. Once again the hydrolyzate is $H_2SO_4$ equilibrated. Number (3) is prepared by cohydrolyzing the silanes in the proportion of n moles of dimethyldichlorosilane, two moles of trimethylmonochlorosilane and c moles of methyldichlorosilane. Once again the hydrolyzate is $H_2SO_4$ equilibrated. Number (4) is prepared by cohydroxylyzing one mole of silane of the formula $R_aSiX_{4-a}$ with n moles of dimethyldichlorosilane, c moles of methyldichlorosilane and thereafter equilibrating with $H_2SO_4$. In such case, X is chlorine.

Another method of preparing the siloxanes is to equilibrate siloxanes that have already been hydrolyzed. Such a method for instance would involve the equilibration at temperatures in excess of 50° C., a mixture of n units of $Me_2SiO$ in the form of octamethylcyclotetrasiloxane, b units of (MeHSiO) in the form of $(MeHSiO)_4$ and 1 unit of $(HMe_2Si)_2O$ in the presence of an equilibrating catalyst. Such equilibrating catalysts are known in the art and consist of acid clays, acid treated melamine type resins and fluorinated alkanes with sulfonic acid groups. For those unfamiliar with such preparations, they can be found in detail in U.S. Pat. No. 3,402,192, and that patent is hereby incorporated by reference.

The monoalkylene ether of the desired polyoxyalkylene glycol can be a copolymer of ethylene oxide and propylene oxide or copolymers of ethylene oxide and butylene oxide or can be copolymers of all three oxides. The ratio of ethylene radicals relative to the other alkylene radicals should be such that the ratio of carbon atoms to oxygen atoms in the glycol copolymer ranges from 2.3:1 to 2.8:1. In addition, the ends of the polyglycol chain not attached to the siloxane moiety have a group A wherein A is defined above.

These glycol copolymers can be linear or branched and can contain any number of carbon atoms.

One method of preparing the glycol copolymers is to dissolve sodium metal in allyl alcohol in a mole ratio of one to one and reacting the resulting product with the appropriate oxides at elevated temperatures and under pressure. The resulting product, after purification by removal of low boilers, is then capped with the appropriate group A.

The siloxane-oxyalkylene copolymer is then prepared by reacting the appropriate siloxane precursor and the appropriate polyglycol copolymer at elevated temperatures in the presence of platinum as the catalyst and a solvent if desired. These polysiloxanepolyoxyalkylene copolymers are described in U.S. Pat. No. 4,147,847.

The silicone surfactant is advantageously dissolved in water, which is inexpensive, does not have an ozone depleting potential, and is not a VOC.

The amount of silicone surfactant dissolved in water should be effective to control void formation at the foam/fabric interface. The amount will vary depending upon the type of surfactant used and the kind of foam and fabric used. We have found that generally from greater than 5 weight percent surfactant is suitable to achieve the desired effects. The upper amount of surfactant is limited only to the extent of cost considerations and keeping a stable solution. Less than 5 wt.% can be employed; however, a greater rate of application must be used.

The silicone coating may be applied in any suitable manner, such as painting with a brush or roller or, most conveniently, by spraying. Because the surfactant is now dissolved in water, airborne particles or volatile emissions are greatly reduced in the spraying operation. The aqueous silicone solution should be applied at a rate sufficient to allow the water to dry from the fabric prior to application of the foaming mixture. The volatilization of water can be enhanced by laying the fabric in a preheated mold, belt, or oven. The solution may be applied to the fabric while cold, after which the fabric is heated, or it may be applied to a warm, optionally thermoformed fabric. In any case, the rate of application and the fabric temperature are easily adjusted to ensure that the water from the applied solution is dried off. The aqueous silicone coating may be applied to any portion of the foam fabric, but preferably to all those portions coming in contact with the polyurethane foaming mixture.

Any urethane foam formulation capable of being molded may be employed in the method of this invention. Such foam compositions, as is well known to those skilled in the art, are prepared from polyols and polyisocyanates in the presence of a foaming agent along with other possible additives. While most applications require the use of a flexible foam, including a semi-flexible foam, the invention also has utility in rigid foam applications.

Polyols which may be employed for reaction with the polyisocyanates to form the flexible polyurethane foams will generally have a number average equivalent weight of from about 500 to 10,000, preferably 3,000 to 10,000, a functionality of from 2 to 8, preferably an average of from 2 to 3, and an OH number of 20 to 115. For rigid foams, the number average equivalent weight will range generally from 90 to less than 500, with average OH numbers from 150 to 700 and average functionalities of 4 or more.

Any suitable hydroxyl-terminated polyester may be used such as is obtained, for example, from polycarboxylic acids and polyhydric alcohols. Any suitable polycarboxylic acid may be used such as oxalic acid, malonic acid, succinic acid, glutaric acid, adipic acid, pimelic acid, suberic acid, azelaic acid, sebacic acid, brassylic acid, thapsic acid, maleic acid, fumaric acid, glutaconic acid, α-hydromuconic acid, β-butyl-α-ethyl-glutaric acid, α,β-diethylsuccinic acid, phthalic acid, isophthalic acid, terephthalic acid, hemimellitic acid, and 1,4-cyclohexanedicarboxylic acid. Any suitable polyhydric alcohol, including both aliphatic and aromatic, may be used such as ethylene glycol, 1,3-propanediol, 1,2-propylene glycol, 1,4-butanediol, 1,3-butanediol, 1,2-butylene glycol, 1,5-pentanediol, 1,4-pentanediol, 1,3-pentanediol, 1,6-hexanediol, 1,7-heptanediol, 2-butene-1,4-diol, glycerol, 1,1,1-trimethylolpropane, 1,1,1-trimethylolethane, hexane-1,2,6-triol, α-methyl glucoside, pentaerythritol, and sorbitol. Also included within the term "polyhydric alcohol" are compounds derived from phenolic compounds such as 2,2-bis(4-hydroxyphenyl)propane, commonly known as Bisphenol A, and hydroxyalkyl ethers of such phenolic compounds such as bis-2-hydroxyethyl ether of hydroxyquinone.

The hydroxy-terminated polyester may also be a polyester amide such as is obtained by including some amine or amino alcohol in the reactants for the preparation of the polyesters. Thus, polyester amides may be obtained by condensing an amino alcohol such as ethanolamine with the polycarboxylic acids set forth above. Or, they may be made using the same components that make up the hydroxy-terminated polyester with only a portion of the components being a diamine such as ethylenediamine. The hydroxy-terminated polyester may also be a hydroxy-terminated polycaprolactone polyol.

Any suitable polyoxyalkylene ether polyol may be used such as the polymerization product of an alkylene oxide or of an alkylene oxide with a polyhydric alcohol. Any suitable polyhydric alcohol may be used such as those disclosed above for the use in the preparation of the hydroxy-terminated polyesters. Any suitable alkylene oxide may be used such as ethylene oxide, propylene oxide, butylene oxide, amylene oxide, and heteric or block copolymers of these oxides. The preferred polyoxyalkylene polyether polyols contain 5 to 70 percent of an ethylene oxide cap. The polyoxyalkylene polyether polyols may be prepared from other starting materials such as tetrahydrofuran and alkylene oxide-tetrahydrofuran copolymers; epihalohydrins such as epichlorohydrin; as well as aralkylene oxides such as styrene oxide. The polyalkylene polyether polyols may have either primary or secondary hydroxyl groups and preferably are polyethers prepared from alkylene oxides having from two to six carbon atoms such as polyethylene ether glycols, polypropylene ether glycols, and polybutylene ether glycols. The polyalkylene polyether polyols may be prepared by any known process such as, for example, the process disclosed by Wurtz in 1859 and *Encyclopedia of Chemical Technology*, Vol. 7, pp. 257–262, published by Interscience Publishers, Inc. (1951) or in U.S. Pat. No. 1,922,459. Alkylene oxide adducts of Mannich condensation products are also useful in the invention. It is preferred that the polyol for reaction with the isocyanate contain 85 to 95 percent polyoxyalkylene polyether polyols. Preferably, it should also contain 2 to 7 percent of one or more diols which are propylene oxide or ethylene oxide adducts of initiators such as ethylene glycol, propylene glycol, diethylene glycol, Bisphenol A, butanediol, or hexanediol.

Alkylene oxide adducts of acids of phosphorus which may be used include those neutral adducts prepared from the alkylene oxides disclosed above for use in the preparation of polyalkylene polyether polyols. Acids of phosphorus which may be used are acids having a $P_2O_5$ equivalency of from about 72 percent to about 95 percent. The phosphoric acids are preferred.

Any suitable hydroxy-terminated polyacetal may be used such as, for example, the reaction product of formaldehyde or other suitable aldehyde with a dihydric alcohol or an alkylene oxide such as those disclosed above.

Any suitable aliphatic thiol include alkane thiols containing at least two —SH groups may be used such as 1,2-ethanedithiol, 1,2-propanedithiol, 1,3-propanedithiol, and 1,6hexanedithiol; alkenethiols such as 2-butene-1,4-dithiol, and alkynethiols such as 3-hexyne-1,6-dithiol.

Any suitable polyamine may be used including aromatic polyamines such as methylene dianiline, polyaryl-polyalkylene polyamine (crude methylene dianiline), p-aminoaniline, 1,5-diaminohaphthalene, and 2,4-diaminotoluene; aliphatic polyamines such as ethylene diamine, 1,3-propylene diamine; 1,4-butylenediamine, and 1,3-butylenediamine, as well as substituted secondary derivatives thereof.

Hydroxy-containing compounds which may be employed include graft polyols which may be employed alone or with the polyols set forth above. Preferably, the polyols comprise by weight 5 to 100 percent graft polyol and 0 to 95 percent conventional polyol of the type described above. The graft polyols are prepared by the in situ polymerization of the product of a vinyl monomer or monomers in a reactive polyol medium and in the presence of a free radical initiator. The reaction is generally carried out at a temperature ranging from about 40° C. to 150° C. The reactive polyol medium generally has an equivalent weight of at least about 500 and a hydroxyl number ranging from about 30 to about 600. The graft polyol has an equivalent weight of at least about 500 and a viscosity of less than 40,000 cps at 10 percent polymer concentration.

A more comprehensive discussion of the graft polyols and their method of preparation can be found in U.S. Pat. Nos. 3,383,351; 3,304,273, 3,652,639; and 3,823,201; the disclosures of which are hereby incorporated by reference.

Also, polyols containing ester groups can be employed in the subject invention. These polyols are prepared by the reaction of an alkylene oxide with an organic dicarboxylic acid anhydride and a compound containing a reactive hydrogen atom. A more comprehensive discussion of these polyols and their method of preparation can be found in U.S. Pat. Nos. 3,585,185; 3,639,541; and 3,639,542.

The polyols described above for reaction with the polyisocyanate preferably should not contain more than 60 percent by weight polyoxyethylene groups.

The blowing agents which can be used may be divided into the chemically active blowing agents which chemically react with the isocyanate or with other formulation ingredients to release a gas for foaming, and the physically active blowing agents which are gaseous at the exotherm foaming temperatures or less without the necessity for chemically reacting with the foam ingredients to provide a blowing gas. Included with the meaning of physically active blowing agents are those gases which are thermally unstable and decompose at elevated temperatures.

Examples of chemically active blowing agents are preferentially those which react with the isocyanate to liberate gas, such as $CO_2$. Suitable chemically active blowing agents include, but are not limited to, water, mono- and polycarboxylic acids having a molecular weight of from 46 to 300, salts of these acids, and tertiary alcohols.

Water is preferentially used as a blowing agent. Water reacts with the organic isocyanate to liberate $CO_2$ gas which is the actual blowing agent. However, since water consumes isocyanate groups, an equivalent molar excess of isocyanate must be used to make up for the consumed isocyanates.

The organic carboxylic acids used are advantageously aliphatic mon- and polycarboxylic acids, e.g. dicarboxylic acids. However, other organic mono- and polycarboxylic acids are also suitable. The organic carboxylic acids may, if desired, also contain substituents which are inert under the reaction conditions of the polyisocyanate polyaddition or are reactive with isocyanate, and/or may contain olefinically unsaturated groups. Specific examples of chemically inert substituents are halogen atoms, such as fluorine and/or chlorine, and alkyl, e.g. methyl or ethyl. The substituted organic carboxylic acids expediently contain at least one further group which is reactive toward isocyanates, e.g. a mercapto group, a primary and/or secondary amino group, or preferably a primary and/or secondary hydroxyl group.

Suitable carboxylic acids are thus substituted or unsubstituted monocarboxylic acids, e.g. formic acid, acetic acid, propionic acid, 2-chloropropionic acid, 3-chloropropionic acid, 2,2-dichlorpropionic acid, hexanoic acid, 2-ethyl-hexanoic acid, cyclohexanecarboxylic acid, dodecanoic acid, palmitic acid, stearic acid, oleic acid, 3-mercapto-propionic acid, glycoli acid, 3-hydroxypropionic acid, lactic acid, ricinoleic acid, 2-aminopropionic acid, benzoic acid, 4-methylbenzoic acid, salicylic acid and anthranilic acid, and unsubstituted or substituted polycarboxylic acids, preferably dicarboxylic acids, e.g. oxalic acid, malonic acid, succinic acid, fumaric acid, maleic acid, glutaric acid, adipic acid, sebacic acid, dodecanedioic acid, tartaric acid, phthalic acid, isophthalic acid and citric acid. Preferable acids are formic acid, propionic acid, acetic acid, and 2-ethylhexanoic acid, particularly formic acid.

The amine salts are usually formed using tertiary amines, e.g. triethylamine, dimethylbenzylamine, diethylbenzylamine, triethylenediamine, or hydrazine. Tertiary amine salts of formic acid may be employed as chemically active blowing agents which will react with the organic isocyanate. The salts may be added as such or formed in situ by reaction between any tertiary amine (catalyst or polyol) and formic acid contained in the polyol composition.

Combinations of any of the aforementioned chemically active blowing agents may be employed, such as formic acid, salts of formic acid, and/or water.

Physically active blowing agents are those which boil at the exotherm foaming temperature or less, preferably at 50° C. or less. The most preferred physically active blowing agents are those which have an ozone depletion potential of 0.05 or less. Examples of physically active blowing agents are the volatile non-halogenated hydrocarbons having two to seven carbon atoms such as alkanes, alkenes, cycloalkanes having up to 6 carbon atoms, dialkyl ethers, cycloalkylene ethers and ketones; hydrochlorofluorocarbons (HCFCs); hydrofluorocarbons (HFCs); perfluorinated hydrocarbons (HFCs); fluorinated ethers (HFCs); and decomposition products.

Examples of volatile non-halogenated hydrocarbons include linear or branched alkanes, e.g. butane, isobutane, 2,3 dimethylbutane, n- and isopentane and technical-grade pentane mixtures, n- and isohexanes, n- and isoheptanes, n- and isooctanes, n- and isononanes, n- and isodecanes, n- and isoundecanes, and n- and isododecanes. Since very good results are achieved with respect to the stability of emulsions, the processing properties of the reaction mixture and the mechanical properties of polyurethane foam products produced when n-pentane, isopentane or n-hexane, or a mixture thereof is used, these alkanes are preferably employed. Furthermore, specific examples of alkenes are 1-pentene, 2-methylbutene, 3-methylbutene, and 1-hexene, of cycloalkanes are cyclobutane, preferably cyclopentane, cyclohexane or mixtures thereof, specific examples of linear or cyclic ethers are dimethyl ether, diethyl ether, methyl ethyl ether, vinyl methyl ether, vinyl ethyl ether, divinyl ether, tetrahydrofuran and furan, and specific examples of ketones are acetone, methyl ethyl ketone and cyclopentanone. Preferentially, cyclopentane, n- and isopentane, n-hexane, and mixtures thereof are employed.

Any hydrochlorofluorocarbon blowing agent may be used in the present invention. Preferred hydrochlorofluorocarbon blowing agents include 1-chloro-1,2-difluoroethane; 1-chloro-2,2-difluoroethane (142a); 1-chloro-1,1-difluoroetane (142b); 1,1-dichloro-1-fluoroethane (141b); 1-chloro-1,1,2-trifluoroethane; 1-chloro-1,2,2-trifluoroethane; 1,1-dichloro-1,2 -difluoroethane; 1-chloro-1,1,2,2-tetrafluoroethane (124a); 1-chloro-1,2,2,2 -tetrafluoroethane(124);1,1-dichloro-1,2,2-trifluoroethane;1,1-dichloro-2,2,2-trifluoroethane (123); and 1,2-dichloro-1,1,2-trifluoroethane (123a); monochlorodifluoromethane (HCFC-22); 1-chloro-2,2,2-trifluoroethane (HCFC-133a); gem-chlorofluoroethylene (R-1131a); chloroheptafluoropropane (HCFC-217); chlorodifluoroethylene (HCFC-1122); and transchlorofluoroethylene (HCFC-1131). The most preferred hydrochlorofluorocarbon blowing agent is 1,1-dichloro-1-fluoroethane (HCFC-141b).

Suitable hydrofluorocarbons, perfluorinated hydrocarbons, and fluorinated ethers include difluoromethane (HFC-32); 1,1,1,2-tetrafluoroethane (HFC-134a); 1,1,2,2 -tetrafluoroethane(HFC-134); 1,1-difluoroethane(HFC-152a); 1,2-difluoroethane(HFC-142), trifluoromethane; heptafluoropropane; 1,1,1-trifluoroethane; 1,1,2-trifluoroethane; 1,1,1,2,2-pentafluoropropane; 1,1,1,3-tetrafluoropropane; 1,1,2,3,3-pentafluoropropane; 1,1,1,3,3 -pentafluoro-n-butane; hexafluorocyclopropane (C-216); octafluorocyclobutane (C-318); perfluorotetrahydrofuran; perfluoroalkyl tetrahydrofurans; perfluorofuran; perfluoro-propane, -butane, -cyclobutane, -pentane, -cyclopentane, and -hexane, -cyclohexane, -heptane, and -octane; perfluorodiethyl ether; perfluorodipropyl ether; and perfluoroethyl propyl ether.

Decomposition type physically active blowing agents which release a gas through thermal decomposition include pecan flour, amine/carbon dioxide complexes, and alkyl alkanoate compounds, especially methyl and ethyl formates.

The total and relative amounts of blowing agents will depend upon the desired foam density, the type of hydrocarbon, and the amount and type of additional blowing agents employed. Polyurethane foam densities typical for rigid polyurethane insulation applications range from free rise densities of 0.5 to 10 pcf, preferably from 1.2 to 3.5 pcf. The amount by weight of all blowing agents is generally, based on 100 pbw of the polyols having at least two isocyanate reactive hydrogens, from 0.05 to 45 pbw.

Water is typically found in minor quantities in the polyols as a byproduct and may be sufficient to provide the desired blowing from a chemically active substance. Preferably, however, water is additionally introduced into the polyol composition in amounts from 0.05 to 5 pbw, preferably from 0.5 to 4 pbw, based on 100 pbw of the polyols. The physically active blowing agents, if employed, make up the remainder of the blowing agent for a total of from 0.05 to 45 pbw.

Conventional surfactants may be incorporated with the polyol to help form a foam from the liquid mixture as well as to control the size of the bubbles of the foam so that a foam of desired structure is obtained. Silicone surfactants are preferred for this purpose and particularly polysiloxane, polyoxyalkylene copolymers such as those described above, and polymethylsiloxanes.

Conventional flame retardants can also be incorporated either with the isocyanate or with the polyols, or both, preferably in an amount of not more than about 20 percent by weight of the reactants.

In addition to the previously described ingredients, other ingredients such as catalysts, dyes, fillers, pigments, and the like can be included in the preparation of the foams.

Conventional fillers for use herein included, for example, aluminum silicate, calcium silicate, magnesium silicate, calcium carbonate, barium sulfate, calcium sulfate, glass fibers, carbon black and silica. The filler, if used, is normally present in an amount by weight ranging from about 5 parts to 100 parts per 100 parts of polyol.

A pigment which can be used herein can be any conventional pigment heretofore disclosed in the art such as titanium dioxide, zinc oxide, iron oxide, antimony oxide, chrome green, chrome yellow, iron blue siennas, molybdate organes and organic pigments such as para reds, benzidine yellow, toluidine red, toners and phthalocyanines.

Any of the catalysts employed in the preparation of polyurethane foam can be employed in the subject invention. Representative of these catalysts include the amine catalysts such as diethylenetriamine, ketimine, triethylenediamine, tetramethylenediamine, tetramethylguanidine, trimethylpiperazine and the metalooorganic salt catalysts which are polyvalent metal salts of an organic acid having up to about 18 carbon atoms and being void of active hydrogen atoms. The organo portion of the salt may be either linear or cyclic or saturated or unsaturated. Generally, the polyvalent metal has a valence from about 2 to 4. Typical of these salts include stannous acetate, stannous butyrate, stannous 2-ethylhexoate, stannous laurate, stannous oleate, stannous stearate, stannous octoate, lead cyclopentanecarboxylate, cadmium cyclohexanecarboxylate, lead naphthenate, lead octoate, cobalt naphthenate, zinc naphthenate, bis(phenyl mercury)dodecyl succinate, phenylmercuric benzoate, cadmium naphthanate, dibutyltin dilaurate and dibutyltin-di-2-ethylhexoate. Generally, the total amount of both tin and amine catalysts ranges from about 0.0 to 2.0 parts by weight based on 100 parts be weight of the polyol. Preferred amounts of tin catalysts are 0.001 to 0.20 part by weight based on 100 parts by weight of the polyol while preferred amounts of amine catalysts are 0.05 to 1.0 part by weight based on 100 parts by weight of the polyol.

In preparing the polyurethane foams of the subject invention, any suitable organic polyisocyanate or mixture thereof can be employed. Representative organic polyisocyanates correspond to the following formula:

$$R(NCO)_z$$

wherein R is a polyvalent organic radical which is either aliphatic, aralkyl, aromatic or mixtures thereof, and z is an integer which corresponds to the valence of R and is at least two. Representative organic polyisocyanates contemplated herein include, for example, the aromatic diisocyanates such as 2,4-toluene diisocyanate, 2,6-toluene diisocyanate, mixtures of 2,4- and 2,6-toluene diisocyanate, crude toluene diisocyanate, methylene diphenyl diisocyanate, crude methylene diphenyl diisocyanate and the like; the aromatic triisocyanates such as 4,4',4:-triphenylmethane triisocyanate, 2,4,6-toluene triisocyanates; the aromatic tetraisocyanates such as 4,4'-dimethyldiphenylmethane-2,2'5,5'-tetraisocyanate, and the like; arylalkyl polyisocyanates such as xylylene diisocyanate; aliphatic polyisocyanates such as hexamethylene-1,6-diisocyanate, lysine diisocyanate methylester and the like; and mixtures thereof. Other organic polyisocyanates include polymethylene polyphenylisocyanate, hydrogenated methylene diphenylisocyanate, M-phenylene diisocyanate, naphthylene-1,5-diisocyanate, 1-methoxyphenylene-2,4-diisocyanate, 4,4'-biphenylene diisocyanate, 3,3' -dimethoxy-4,4'-biphenyl diisocyanate, 3,3'-dimethyl-4,4'-biphenyl diisocyanate, and 3,3' -dimethyldiphenylmethane-4,4'-diisocyanate. These polyisocyanates are prepared by conventional methods known in the art such as the phosgenation of the corresponding organic amine. Included within the useable isocyanates are the modifications of the above isocyanates which contain carbodiimide, allophanate or isocyanurate structures. Quasiprepolymers may also be employed in the process of the subject invention. These quasiprepolymers are prepared by reacting an excess of organic polyisocyanate or mixtures thereof with a minor amount of an active hydrogen-containing compound as determined by the well-known Zerewitinoff test, as described by Kohler in *Journal of the American Chemical Society,* 49, 3181 (1927). These compounds and their methods of preparation are well known in the art. The use of any one specific active hydrogen compound is not critical hereto, rather any such compound can be employed herein. Generally, the quasi-prepolymers have a free isocyanate content of from 20 percent to 40 percent by weight.

Crude polyisocyanate may also be used in the compositions of the present invention, such as crude toluene diisocyanate obtained by the phosgenation of a mixture of toluene diamines or crude polymethylene polyphenylene polyisocyanate obtained by the phosgenation of crude polymethylene polyphenylene polyamine.

The amount of organic polyisocyanate that is employed should generally be sufficient to provide about an isocyanate index of 0.6 to 1.5.

In preparing the foams of the present invention, any general procedure conventionally used for the preparation of urethane foams can be practiced. Generally speaking, such procedure entails the mixing together of ingredients with agitation until the foaming reaction commences. Such mixture is then poured into contact with a fabric placed in an optionally but preferably preheated mold whereby the polyurethane foaming mixture expands in contact with the coated portion of the fabric. Generally, the foaming mixture component temperatures are preferably from about 60° to 140° F. After foam formation ceases, the resulting product is then cured at an ambient temperature and pressure; or curing may be accelerated through the use of higher temperatures. The preferred curing temperature ranges from about 25° C. to 150° C. and curing is usually about one (1) or more minutes. There is no known maximum curing time and such foams have been prepared which were cured for one week or longer. Preferably, the curing time should not require more than 24 hours. The foams have good adhesion to the fabric due to their fine uniform cell structure. The foams employed in the instant invention should preferably have a density of about 1 to 15 pounds per square foot and should have a thickness from about 0.75 to 6 inches. When making a molded foam, it is helpful to overpack the mold beyond the theoretical amount required for a free rise foam to fill the mold in order to improve the cell structure and reduce the formation of voids. We have found that as the packing ratio increases, the tendency to form voids and bubbles is reduced. However, the amount of overpacking should be kept minimal in order to minimize the amount of raw materials used. It is also possible to proceed with the preparation of the polyurethane plastics by a prepolymer technique wherein an excess of organic polyisocyanate is reacted in a first step with a polyol, as described above, to prepare a prepolymer having free isocyanate groups which is then reacted in a second step with water to prepare a foam. Alternately, the components may be reacted in a single working step commonly known as the "one-shot" technique of preparing polyurethanes.

For more complete understanding of the present invention, reference is made to the following non-limiting examples wherein all parts are by weight unless otherwise noted.

EXAMPLE 1

A 10 weight percent solution of a polysiloxane polyoxyalkylene copolymer surfactant identified in the table below dissolved in water was sprayed with a fine mist onto the fabric side of an 8"×8" piece of textile fabric reinforced vinyl sheet and placed in a 2"×9"×9" mold preheated at the identified temperatures. A two-component, flexible polyurethane foam, commercially available from BASF Corporation as Elastoflex® 25080-T isocyanate and Elastoflex® 25080-R resin, was handmixed at the stated parts by weight ratios and at 2340 ppm for five (5) seconds; and a portion was poured onto the surfactant coated fabric reinforced vinyl. After the foam was poured, the mold was shut, and the foam was allowed to rise. The part was demolded and allowed to cure. The foam was then peeled from both pieces of vinyl for examination.

A comparison of Samples 1 and 2 reveals that a high amount of overpacking reduced the frequency and size of voids. However, it is undesirable to use a large amount of raw material per part. A comparison of Samples 1 and 3, each without any application of surfactant and at low part weights, with Sample 5 demonstrates that the application of the sprayed surfactant was effective in reducing the frequency and size of voids. The same is true of Sample 7 which showed a reduction of the frequency and size of voids compared to Sample 6.

TABLE 1

| SAMPLE | SURFACTANT | P.B.W. RATIO ISO/RESIN | MOLD TEMP. (°F.) | WEIGHT OF PART (GRAMS) | VOID FORMATION |
|---|---|---|---|---|---|
| 1 | NONE | 100/52 | 100 | 220 | LARGE SIZE VOIDS |
| 2 | NONE | 200/104 | 102 | 350 | SMALL SIZE AND FEW VOIDS |
| 3 | NONE | 100/52 | 110 | 221 | LARGE SIZE VOIDS |
| 4 | NONE | 200/104 | 110 | 339 | SMALL SIZE VOIDS |
| 5 | 10% DC 190[2] IN $H_2O$[1] | 100/152 | 101 | 214 | VERY FEW AND SMALL SIZE VOIDS |
| 6 | NONE | 100/52 | 120 | 218.9 | MANY AND LARGE VOIDS |
| 7 | 10% DC 198[2] IN $H_2O$ | 100/52 | 120 | 221.6 | VERY FEW AND SMALL VOIDS |
| 8 | 10% DC 198[2] IN $H_2O$ | 150/78 | 121 | — | VERY FEW AND SMALL VOIDS |

[1]This aqueous solution also contained 1 weight percent of CT 180 violet pigment.
[2]These surfactants are commercially available from Air Products and Chemicals, Inc. as DABCO ™ DC-190 and DABCO ™ DC-198.

What is claimed is:

1. A method of applying polyurethane foam to fabric comprising;

(a) coating at least a portion of the fabric with a coating comprising silicone surfactant dissolved in a solvent comprising water, and (b) expanding a polyurethane foaming mixture in contact with the portion of said fabric coated in step (a).

2. The method of claim 1, wherein water comprises 90 weight percent or more of the solvent used to dissolve the surfactant.

3. The method of claim 2, wherein the solvent used to dissolve the surfactant consists of water.

4. The method of claim 1, wherein the surfactant is soluble in water and forms a solution in water without the aid of additional solvating agents.

5. The method of claim 1, wherein said fabric comprises textile fabric reinforced vinyl.

6. The method of claim 1, wherein said fabric comprises textile fabric reinforced polyurethane.

7. The method of claim 1, wherein said coating is applied at about 0.01 to 2.0 grams per square foot.

8. The method of claim 7, wherein said silicone surfactant comprises a polysiloxanepolyoxyalkylene copolymer.

9. The method of claim 7, wherein said polyurethane is poured in step (b) onto said fabric at a temperature of 60° F. to 140° F. and cured for at least one minute at a temperature of from about 25° C. to 150°C.

10. The method of claim 9, wherein said silicone surfactant comprises a polysiloxanepolyoxyalkylene copolymer.

11. The method of claim 10, wherein said fabric comprises textile fabric reinforced vinyl.

12. The method of claim 10, wherein said fabric comprises textile reinforced polyurethane.

13. The method of claim 1, wherein the amount of surfactant is greater than 5 weight percent based on the weight of the coating.

14. The method of claim 1, wherein said coating is substantially dried of water prior to application of the foaming mixture.

15. A method of applying polyurethane foam to a fabric, comprising:

(a) coating at least a portion of the fabric with a coating comprising a silicone surfactant dissolved in a solvent comprising water, and (b) expanding a polyurethane foaming mixture in contact with the portion of said fabric coating in step (a), wherein said polyurethane foaming mixture comprises a blowing agent chemically reactive with an organic isocyanate.

16. The method of claim 15, wherein said polyurethane foaming mixture comprises the reaction between an organic isocyanate and a mixture of polyols, said blowing agent, and a catalyst.

17. The method of claim 16, wherein said blowing agent comprises water.

18. The method of claim 17, wherein water ranges in an amount of 0.5 to 4 pbw, based on 100 pbw of polyols.

19. The method of claim 16, wherein said catalyst comprises an amine catalyst and/or a metallo-organic salt of an organic acid having up to 18 carbon atoms.

20. The method of claim 19, wherein the amount of amine catalyst is from 0.05 to 1.0 pbw, based on 100 pbw of the polyols.

21. The method of claim 16, wherein the mixture further comprises a silicone surfactant.

* * * * *